US011760551B2

(12) United States Patent
Fava et al.

(10) Patent No.: US 11,760,551 B2
(45) Date of Patent: Sep. 19, 2023

(54) GLASS CONTAINER

(71) Applicant: Bormioli Luigi S.p.A., Parma (IT)

(72) Inventors: Emanuela Fava, Parma (IT); Luca Ugolotti, Parma (IT); Alberto Juan Sanchez Garcia, Salsomaggiore Terme (IT)

(73) Assignee: Bormioli Luigi S.p.A., Parma (IT)

( * ) Notice: Subject to any disclaimer, the term of this patent is extended or adjusted under 35 U.S.C. 154(b) by 0 days.

(21) Appl. No.: 17/305,073

(22) Filed: Jun. 30, 2021

(65) Prior Publication Data

US 2022/0017279 A1 Jan. 20, 2022

(30) Foreign Application Priority Data

Jul. 17, 2020 (IT) ..... 102020000017410

(51) Int. Cl.
*B65D 77/04* (2006.01)
*A45D 33/00* (2006.01)
(Continued)

(52) U.S. Cl.
CPC ..... *B65D 77/0493* (2013.01); *A45D 33/003* (2013.01); *A45D 34/00* (2013.01);
(Continued)

(58) Field of Classification Search
CPC ..... B65D 77/0493; B65D 43/0231; B65D 2543/00092; B65D 2543/00231;
(Continued)

(56) References Cited

U.S. PATENT DOCUMENTS 5,938,016 A * 8/1999 Erdtmann ..... A45D 40/0068 220/495.08
6,006,937 A * 12/1999 Baravaglio ..... B65D 51/20 206/823
(Continued)

FOREIGN PATENT DOCUMENTS

CN 111386056 A * 7/2020 ..... A45D 33/003
FR 2997828 A1 * 5/2014 ..... A45D 40/00
(Continued)

OTHER PUBLICATIONS

Italian Search Report dated Mar. 31, 2021 in Italian Application 102020000017410 filed on Jul. 17, 2020, 3 pages (with English Translation of Categories of Documents).

*Primary Examiner* — Jennifer Robertson
*Assistant Examiner* — Eric C Baldrighi
(74) *Attorney, Agent, or Firm* — Oblon, McClelland, Maier & Neustadt, L.L.P.

(57) ABSTRACT

A container includes an external receptacle including glass and has a bottom and a side wall to define an inner cavity. An internal receptacle includes glass, is housed within the inner cavity of the external receptacle, and has a bottom and a side wall. An intermediate element, including plastic or elastomeric material, is interposed between the internal receptacle and the external receptacle. The side wall of the internal receptacle includes a ring having a free upper face and a lower contact surface. The intermediate element is interposed between the lower contact surface of the ring and a support surface on a collar at the upper end of the side wall of the external receptacle. The collar has a step-like seat open upwards and toward the inner cavity of the external receptacle and extending between an upper free face of an upper edge of the collar and the support surface.

10 Claims, 3 Drawing Sheets

(51) Int. Cl.
*A45D 34/00* (2006.01)
*A45D 40/00* (2006.01)
*B65D 43/02* (2006.01)

(52) U.S. Cl.
CPC ..... *A45D 40/0068* (2013.01); *B65D 43/0231* (2013.01); *A45D 2200/05* (2013.01); *B65D 2543/00092* (2013.01); *B65D 2543/00231* (2013.01); *B65D 2543/00296* (2013.01); *B65D 2543/00305* (2013.01); *B65D 2543/00537* (2013.01)

(58) Field of Classification Search
CPC ..... B65D 2543/00296; B65D 2543/00305; B65D 2543/00537; A45D 33/003; A45D 34/00; A45D 40/0068; A45D 2200/05; A45D 33/22
USPC ..... 220/23.87
See application file for complete search history.

(56) References Cited

U.S. PATENT DOCUMENTS

| | | | | |
|---|---|---|---|---|
| 10,160,578 | B2 * | 12/2018 | Harvey | B65D 25/34 |
| 2020/0085166 | A1 * | 3/2020 | Salciarini | B65D 43/0212 |

FOREIGN PATENT DOCUMENTS

| | | | | |
|---|---|---|---|---|
| FR | 3 056 087 | A1 | 3/2018 | |
| FR | 3 060 271 | A1 | 6/2018 | |
| FR | 3 067 328 | A1 | 12/2018 | |
| FR | 3067327 | A1 * | 12/2018 | A45D 40/0068 |
| FR | 3109283 | A1 * | 10/2021 | A45D 40/00 |
| WO | WO-0108995 | A1 * | 2/2001 | A47J 47/14 |

* cited by examiner

GLASS CONTAINER

The present invention relates to a container for cosmetic products of the type comprising an external receptacle having substantially a protective and packaging function and an internal receptacle, inserted inside the aforesaid external receptacle and destined to materially contain the cosmetic product.

Obviously, the container according to the invention is suitable for containing liquid, creamy, gel or powder products, also not necessarily related to the field of cosmetics.

In the prior art, containers for cosmetic products are generally made of glass or plastic.

Plastics have the advantage of being lightweight and inexpensive, but they can present problems of chemical incompatibility with certain products and are often perceived by consumers as being associated with lower quality products.

Moreover, nowadays the problem of environmental pollution is increasingly felt and, consequently, the general trend is to eliminate, or at least reduce as much as possible, the use of plastics.

For its part, glass is undoubtedly a more 'noble' material, which generally does not create problems of compatibility with the products contained in the jars and which can contribute to consolidating, in the consumer's eyes, the perception of high quality of the product. On the other hand, glass is a heavy and relatively expensive material. Therefore, the need for receptacles for cosmetic products, made up of glass, which are also sufficiently lightweight and economical to produce is particularly felt.

A further problem in containers of the double (external and internal) receptacle type is that, if both receptacles are made up of glass, the physical and mechanical characteristics of the material make the assembly of the two receptacles in a stable manner without risk of breakage difficult.

For this reason, most double-receptacle containers are made with one of the two receptacles (generally the internal one, intended for contact with the cosmetic product) in glass and the other in plastics.

There are also known embodiments (as, for example, in the French patent FR 3067328) in which both receptacles are made of glass, with an intermediate plastic element interposed therebetween at the mutual contact area, so as to favour the mechanical coupling between the two receptacles.

In the solution proposed by FR 3067328, the internal receptacle is supported by the external receptacle directly on the free upper face of the upper circumferential edge, or neck, thereof. The internal receptacle, however, excessively projects upwards compared to the external container and this causes both an increase in the overall height dimension of the entire container compared to its internal capacity, and the need to provide a considerably thick cap in order to reach the thread provided on the external surface of the neck of the external receptacle, making both the cap itself and the entire container excessively heavy.

This clashes against the current requirements for reducing weight, saving raw materials and saving energy for processing. In addition, the excessive height of the neck of the external receptacle (i.e. a part directly visible to the eyes of the observer) can make the container unattractive from an aesthetic point of view.

The general object of the present invention is to obviate the above mentioned drawbacks by providing a glass container for cosmetic products, of the double receptacle type, which allows to obtain a saving of material, and therefore of weight and of energy required during the production process, as well as a lower overall height with respect to its horizontal dimension and therefore a more pleasing aesthetic appearance.

In view of said purpose, according to the invention, it has been thought to realize a container for containing products, particularly cosmetic products, comprising an external glass receptacle, provided with a bottom and a side wall suitable to define an inner cavity, an internal glass receptacle, designed to be housed within the inner cavity of said external receptacle and provided in turn with a bottom and a side wall suitable to define an own inner cavity for containing the product, and an intermediate element made up of plastic or elastomeric material, destined to be interposed between respective, mutual contact portions of the internal receptacle and of the external receptacle, the side wall of the internal receptacle being provided, at its upper end, with a ring having a free upper face and a lower contact surface and the intermediate element being interposed at least between said lower contact surface of the ring of the internal receptacle and a support surface on a collar provided at the upper end of the side wall of the external receptacle, characterized in that said collar is provided, in correspondence of its upper edge, with a step-like seat open upwards and toward the inner cavity and extending between a free upper face of said upper edge and a lower rest surface realizing said support surface of the intermediate element on the collar.

To clarify the explanation of the innovative principles of the present invention and the advantages thereof with respect to the prior art, one possible illustrative embodiment applying such principles will be described below, with the aid of the attached drawings.

Figure 1:
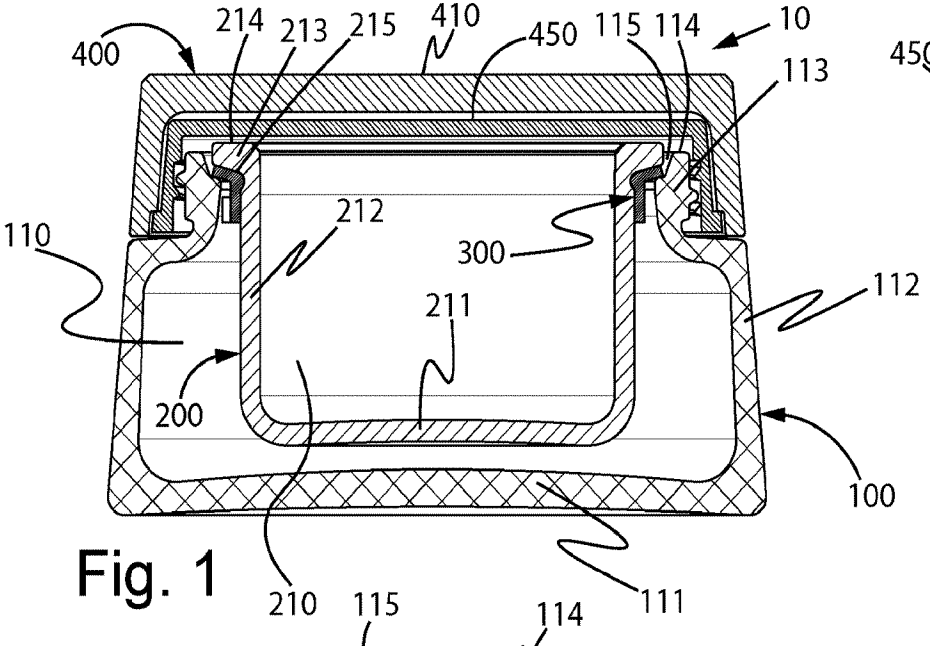
FIG. 1 represents a sectional view of the container according to the invention, with all its components in an assembled condition.
Figure 3:
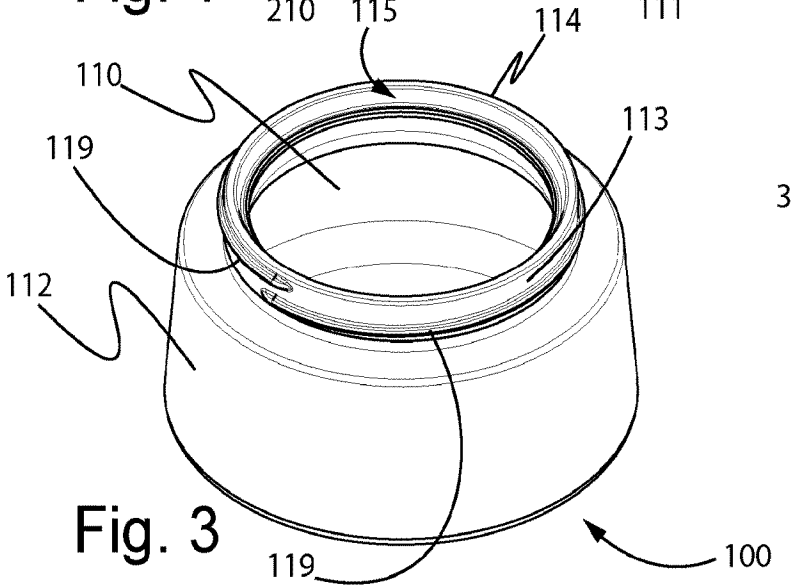
FIG. 3 represents an axonometric view of the external receptacle of the container according to the invention.
Figure 7:
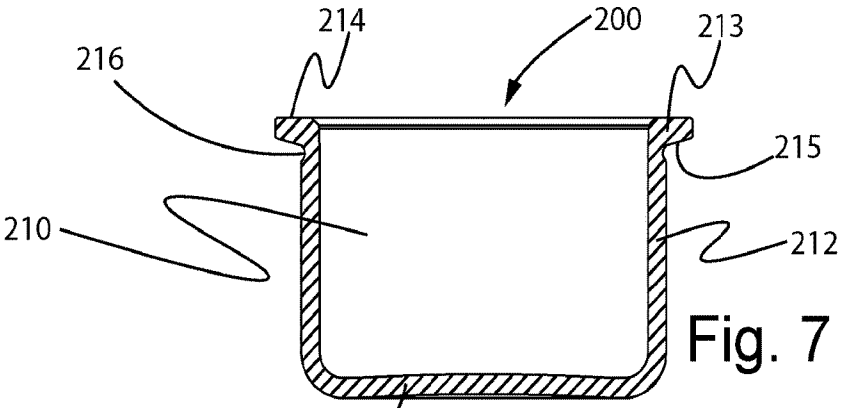
FIG. 7 represents a sectional view of the internal receptacle of FIG. 6.

With reference to the figures, FIG. 1 illustrates, sectioned along a vertical plane, a container 10 preferably, but not necessarily, intended to contain cosmetic products in a liquid, creamy, gel or powder state.

The container 10 is of the so-called 'double receptacle' type, comprising an external receptacle 100 and an internal receptacle 200.

The internal receptacle 200, made of glass, is intended to materially contain, in its own inner cavity 210, the cosmetic product (not shown in the drawings) and is in turn housed in an inner cavity 110 of the external receptacle 100.

The external receptacle 100, also made of glass, is instead intended essentially to protect the internal receptacle 200, while performing a packaging function for the cosmetic product.

In the event that the internal receptacle is intended to be removable from the external receptacle, the internal receptacle 200 may be of the 'disposable type', while the external receptacle 100 will be reusable, by inserting another internal receptacle filled with new product.

An intermediate element 300 is provided between the external receptacle 100 and the internal receptacle 200, specifically in the mutual contact area therebetween, suitable for facilitating the mechanical coupling between the two receptacles, ensuring in particular the centring and stability of the internal receptacle 200 in the external receptacle 100, without risk of breakage that could occur due to any direct contact between the two glass receptacles.

The container 10 is further designed to be provided with a closing lid 400, which in turn comprises an outer glass shell 410 and an inner plastic insert 450, provided with removable fixing means for fixing to the external receptacle 100.

As visible in FIGS. 1-5, the external receptacle 100 essentially comprises a bottom 111 and a side wall 112, suitable for defining said inner cavity 110. The side wall 112 is provided, at its upper end, with a collar 113 having an upper edge 114. The configuration of this portion of the external receptacle 100 is illustrated in greater detail in the enlargement of FIG. 2.

Figure 2:
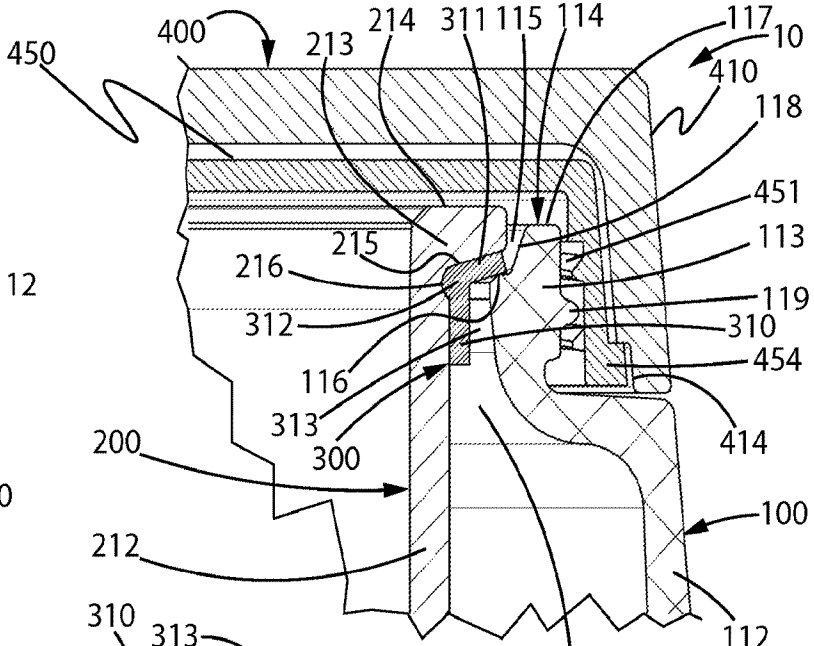
FIG. 2 represents an enlarged view of a detail of FIG. 1, which shows more in detail the mutual coupling of the components of which the container is constituted.
Figure 10:
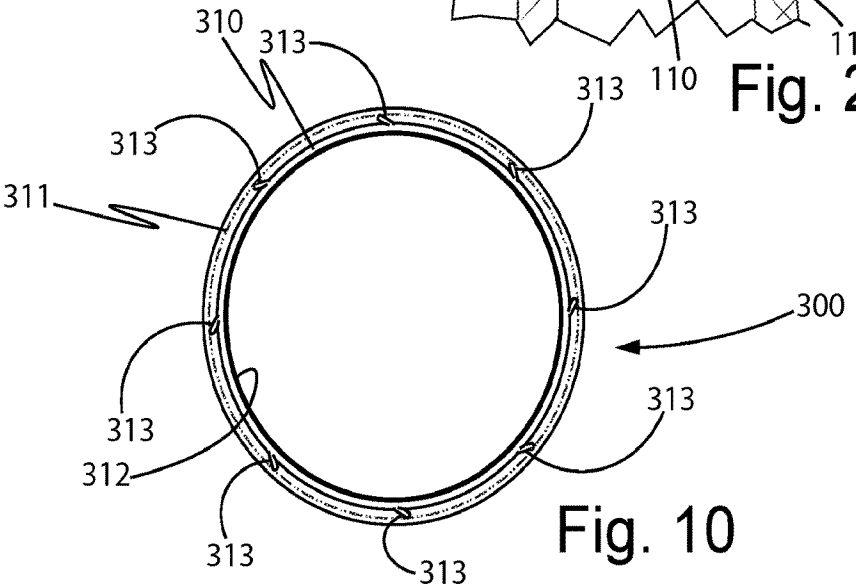
FIG. 10 represents a plan view from below of the intermediate element of FIG. 8.

As clearly shown in FIG. 2, the collar 113 of the side wall 112 of the external receptacle 100 is provided, in correspondence of its upper edge 114, with a step-like seat 115 open upwards and toward the inner cavity 110. In particular, the step-like seat 115 extends between a lower rest surface 116 and the free upper face 117 of said upper edge 114 of the external receptacle 100. Advantageously, as can be well observed in FIG. 2, the connecting wall 118 between the lower rest surface 116 of said step-like seat 115 and the free upper face 117 inclines towards the outside of the receptacle 100 upon rising to said free upper face 117, for reasons that will be clarified below.

As visible in FIGS. 1, 2, 6 and 7, the internal receptacle 200 in turn comprises a bottom 211 and a side wall 212. Said side wall 212 is provided, at its upper end, with a ring 213 having a free upper face 214 and a lower contact surface 215. The configuration of this portion of the internal receptacle 200 is illustrated in greater detail in the enlargement of FIG. 2.

In the area immediately below the lower contact surface 215, the side wall 212 of the internal receptacle 200 is shaped with a circumferential groove 216, the function of which will be described below.

Figure 9:
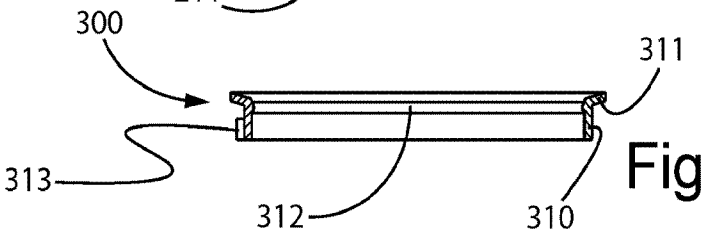
FIG. 9 represents a sectional view of the intermediate element of FIG. 8.
Figure 5:
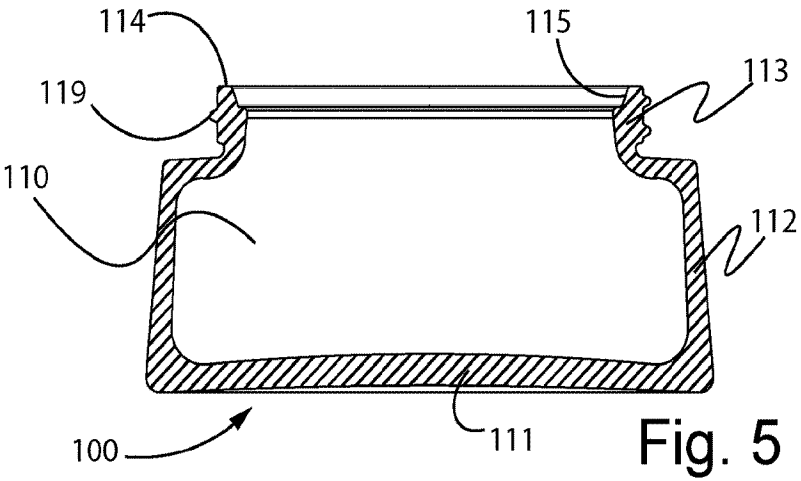
FIG. 5 represents a sectional view of the external receptacle of FIG. 3.
Figure 6:
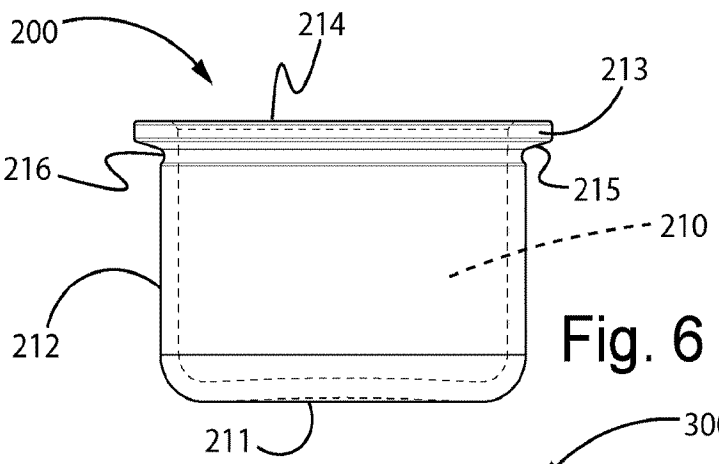
FIG. 6 represents a side elevation view of the internal receptacle of the container according to the invention.
Figure 8:
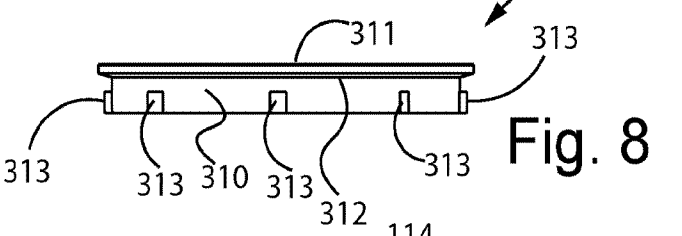
FIG. 8 represents a side elevation view of the intermediate element of the container according to the invention.
Figure 4:
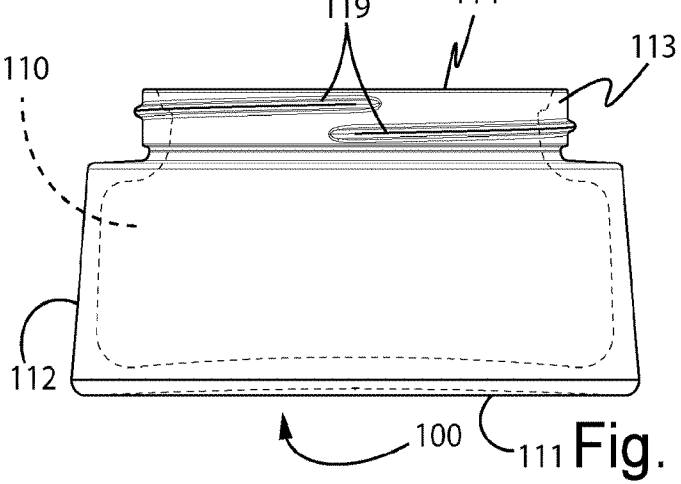
FIG. 4 represents a side elevation view of the external receptacle of FIG. 3.
Figure 12:
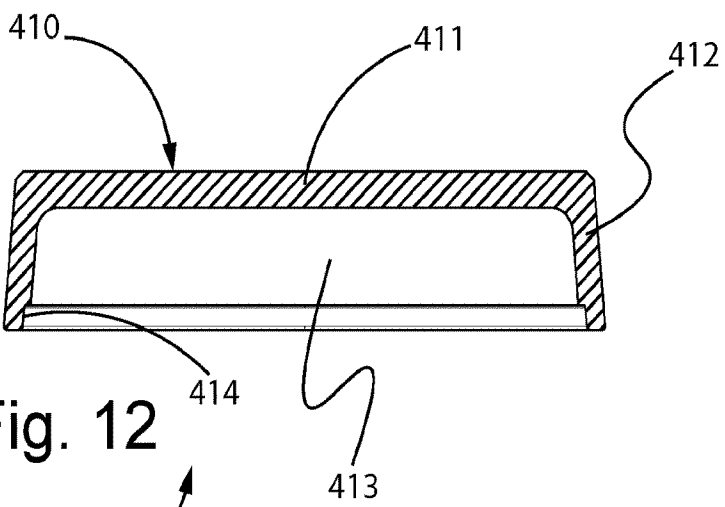
FIG. 12 represents a sectional view of the lid of FIG. 11.
Figure 14:
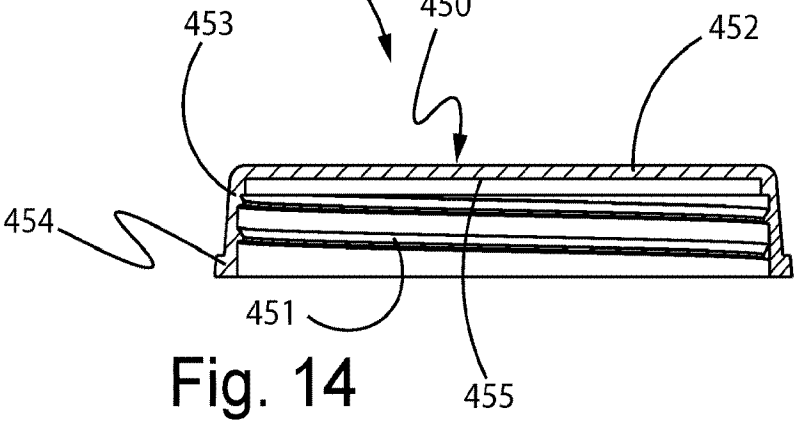
FIG. 14 represents a sectional view of the inner insert of FIG. 13.
Figure 11:
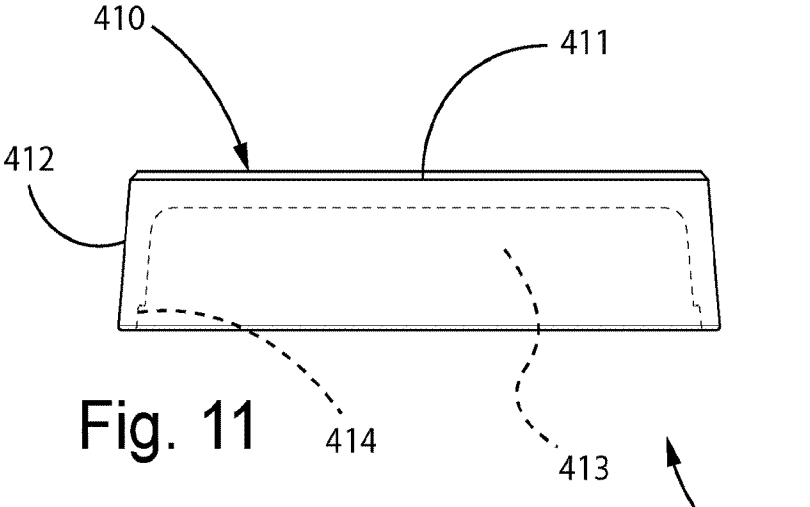
FIG. 11 represents a side elevation view of the lid of the container according to the invention.
Figure 13:
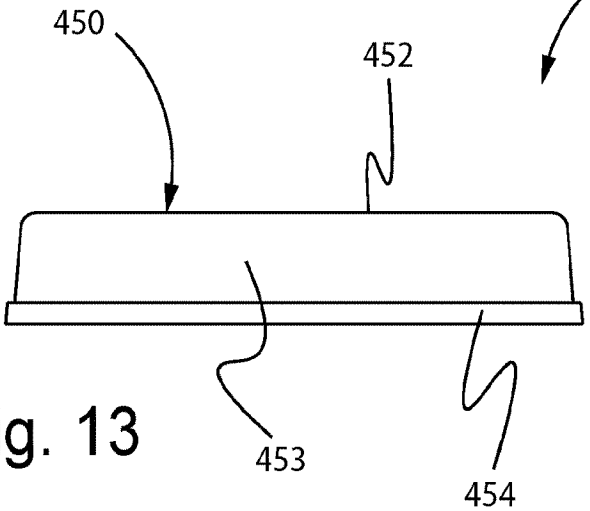
FIG. 13 represents a side elevation view of the inner insert of the lid of FIG. 11.

The intermediate element 300, advantageously made up of plastic or elastomeric material so as to adapt to the unavoidable constructive tolerances of the two glass receptacles 100 and 200, has an annular shape with a substantially upset "L" cross-section, as clearly visible in FIGS. 1, 2 and 9.

More precisely, the "L"-shaped section of the intermediate element 300 comprises a substantially vertical lower portion 310 and an upper portion 311 transversally extending outwards with respect to said lower portion starting from a central angular portion 312.

Advantageously, said central angular portion 312 of the intermediate annular element 300 has a rib slightly protruding towards the centre of the ring (and, therefore, of the container 10), which is complementary to the circumferential groove 216 of the side wall 212 of the internal receptacle 200.

The lower portion 310 of the intermediate annular element 300 further has a plurality of fins 313 protruding outwards of the ring in the direction of the collar 113 of the side wall 112 of the external receptacle 100. Preferably, the fins 313 are uniformly distributed along the circumference of the annular element 300, protruding at a different inclination with respect to the radial direction.

The intermediate annular element 300 is suitable for being fitted externally to the side wall 212 of the internal receptacle 200, with its lower portion 310 adhering to the external surface of said side wall 212, with the rib of the central angular portion 312 inserted in the circumferential groove 216 of the side wall 212 itself and with the upper portion 311 adhering to the lower contact surface 215 of the upper ring 213 of the side wall 212, as clearly visible in FIG. 2.

As mentioned, the intermediate annular element 300 is intended to be interposed between the internal receptacle 200 and the external receptacle 100. In particular, as clearly shown in FIG. 2, the internal receptacle 200 is supported by the external receptacle 100 by interposition of the upper portion 311 of the intermediate annular element 300 between the lower contact surface 215 of the upper ring 213 and the lower rest surface 116 of the step-like seat 115 present in the upper edge 114 of the external receptacle 100.

In addition, the fins 313 protruding outwards from the lower portion 310 of the intermediate annular element 300 interfere with the inner surface of the collar 113 of the side wall 112 of the external receptacle 100, so as to ensure a proper locking and centring of the internal receptacle 200 in the external receptacle 100. In particular, the accidental extraction of the internal receptacle from the external receptacle is prevented.

The inclination of the connecting wall 118 between the lower rest surface 116 of the step-like seat 115 and the free upper face 117 of the upper edge 114 of the external receptacle 100 favours as much as possible the correct insertion and centring of the internal receptacle in the external one, avoiding possible direct contacts between the ring 213 and the collar 113, potentially harmful for the integrity of the glass container.

The height of the step-like seat 115 present in the collar 113 of the external receptacle 100 (i.e. the difference in height between its lower rest surface 116 and the free upper face 117 of the upper edge 114 of the collar) and the thickness of the ring 213 of the internal receptacle 200 are advantageously chosen so that, when the internal receptacle 200 is correctly inserted into the external receptacle 100 by interposition of the intermediate element 300, the free upper face 214 of the ring 213 of the internal receptacle 200 protrudes slightly above the free upper face 117 of the collar 113 of the external receptacle 100, so as to ensure the tightness of the closing lid 400, as will be clarified below.

In any case, the presence of the step-like seat 115 in which the ring 213 of the internal receptacle is housed allows reducing the overall height of the container (in particular, the distance between the bottom 111 of the external receptacle 100 and the free upper face 214 of the internal receptacle 200) compared to solutions such as the one described in FR 3067328, obtaining a container with a lower ratio between its height and its internal capacity and also reducing the thickness that the closing lid needs in order to be screwed onto the external receptacle.

As mentioned above, the container 10 also comprises a closing lid 400, which is suitable for preserving the product in an appropriate manner and for preventing it from spilling out of the container if it is tipped over.

Advantageously, the closing lid 400 consists of an outer glass shell 410 having an upper wall 411 and a side wall 412, suitable for defining an inner cavity 413, and an inner plastic insert 450, housed in said inner cavity 413 of the outer glass shell 410 and provided with an inner thread 451 intended to cooperate with a corresponding outer thread 119 present on the outer surface of the collar 113 of the external receptacle 100.

The insert 450 is in turn conformed with an upper wall 452 intended to realize a closure of the inner cavity 210 of the internal receptacle 200, to prevent the spillage of the product contained therein, and with a side wall 453 in which said inner thread 451 is formed. The coupling between the outer glass shell 410 and the plastic insert 450 can of course be obtained in various ways, well known to the expert in the art, such as mechanical coupling, by gluing or both.

In the embodiment illustrated in FIGS. 11-14 (as well as in the enlargement of FIG. 2), the side wall 453 of the plastic insert 450 is provided at the bottom with a circumferential protrusion 454 and the side wall 412 of the outer glass shell 410 is provided with a grooved seat 414 at the inside, suitable both for accommodating the aforesaid circumferential protrusion 454 of the insert 450, and for receiving the adhesive used for assembling the two components.

When the closing lid 400 is screwed onto the external receptacle 100, by engagement of the respective threads 451 and 119, the lower face 455 of the upper wall 452 of the plastic insert 450 is in abutment against the free upper face 214 of the ring 213 of the internal receptacle 200, so as to ensure the tightness of the closing lid 400, preventing the product from spilling out of the container and also ensuring proper preservation thereof.

It is at this point clear how the container according to the invention has enabled the intended purposes to be achieved.

In particular, it has been possible to obtain a container for cosmetic products, of the double receptacle type, in which most of the components are made of glass (therefore of high quality and pleasant aesthetic appearance), with a significant saving of material (and therefore of weight and energy necessary during the production process).

Furthermore, since both the intermediate element 300 and the insert 450 of the closing lid 400 are easily removable from the side wall of the internal receptacle 200 and from the outer shell 410 of the lid, respectively, all materials used (both glass and plastics) can be separated and completely recycled.

Clearly, the above description of an embodiment applying the innovative principles of the present invention is given by way of an illustrative example of such innovative principles and must not, therefore, be taken to limit the scope of the patent claimed herein.

For example, if the intermediate element 300 is made up of elastomeric material, the rib protruding from its central angular portion 312 may not be necessary, since the elastic characteristics of the material would still ensure optimal insertion into the circumferential groove 216 of the side wall 212 of the internal receptacle 200.

In addition, the upper ring 213 of the internal receptacle 200 may be provided for fixing, for example by a thermo-sealing process, a film (made up of plastic, aluminium or composite material) for closing the receptacle itself, so that the internal receptacle 200, and the product contained therein, may be sold as a refill without the need to purchase the entire container including the external receptacle, internal receptacle and closing lid.

Finally, it should be considered that the components defined herein as made of glass could also be made of other materials with similar chemical-physical characteristics.

The invention claimed is:

1. A container for containing a product, particularly a cosmetic product, the container comprising:

an external receptacle comprising glass and provided with a bottom and a side wall suitable to define an inner cavity;

an internal receptacle comprising glass, designed to be housed within the inner cavity of said external receptacle and provided in turn with a bottom and a side wall suitable to define an inner cavity for containing the product; and an intermediate element made up of plastic or elastomeric material, destined to be interposed between respective, mutual contact portions of the internal receptacle and of the external receptacle, the side wall of the internal receptacle being provided, at its upper end, with a ring having a free upper face and a lower contact surface, the intermediate element being interposed at least between said lower contact surface of the ring of the internal receptacle and a support surface on a collar provided at the upper end of the side wall of the external receptacle, wherein said collar is provided, in correspondence of its upper edge, with a step-like seat open upwards and toward the inner cavity of the external receptacle and extending between an upper free face of said upper edge and a lower rest surface realizing said support surface of the intermediate element on the collar, wherein the intermediate element has an annular shape with an upset L cross-section which has a substantially vertical lower portion and an upper portion transversally extending outwards with respect to said lower portion starting from a central angular portion, and said upper portion is supported by and in contact with a bottom of the step-like seat.

2. The container according to claim 1, wherein the step-like seat has a connecting wall between the lower rest surface and the upper free face of the upper edge, which inclines towards the outside of the external receptacle upon rising to said upper free face.

3. The container according to claim 1, wherein the free upper face of the ring of the internal receptacle projects upwards with respect to the upper free face of the collar of the external receptacle.

4. The container according to claim 1, wherein said upper portion is designed to be interposed between the lower contact surface of the ring of the side wall of the internal receptacle and the lower rest surface of the step-like seat provided in the upper edge of the collar of the external receptacle.

5. The container according to claim 4, wherein the lower portion of the intermediate annular element is intended to adhere to the outer surface of the side wall of the internal receptacle and has a plurality of fins distributed along its circumference and protruding outwards to interfere with the inner surface of the collar of the side wall of the external receptacle.

6. The container according to claim 4, wherein in the area immediately below the lower contact surface of the ring, the side wall of the internal receptacle has a circumferential groove and in that the central angular portion of the intermediate annular element has a rib complementary to said circumferential groove for insertion into it when the intermediate annular element is fitted on the side wall of the internal receptacle.

7. The container according to claim 1, further comprising a closing lid suitable for being removably fixed to the external receptacle.

8. The container according to claim 7, wherein the closing lid is made with an outer glass shell and an inner plastic insert provided with an inner thread intended to cooperate with a corresponding outer thread present on the outer surface of the collar of the external receptacle.

9. The container according to claim 8, wherein said inner thread is realized in a side wall of the inner plastic insert.

10. The container according to claim 9, wherein the side wall of the inner plastic insert is provided at a bottom of the side wall of the inner plastic insert with a circumferential protrusion suitable for being housed in a grooved seat provided internally in a side wall of the outer glass shell.

* * * * *